US006167956B1

(12) United States Patent
Bostedo et al.

(10) Patent No.: US 6,167,956 B1
(45) Date of Patent: Jan. 2, 2001

(54) AFTERCOOLER HAVING BYPASS PASSAGE INTEGRALLY FORMED THEREWITH

(75) Inventors: Robert Bostedo, Export; Brian L. Cunkelman, Blairsville, both of PA (US)

(73) Assignee: Westinghouse Air Brake Company, Wilmerding, PA (US)

( * ) Notice: Under 35 U.S.C. 154(b), the term of this patent shall be extended for 0 days.

(21) Appl. No.: 09/382,299

(22) Filed: Aug. 24, 1999

(51) Int. Cl.[7] ..... G05D 15/00

(52) U.S. Cl. ..... 165/284; 165/103; 165/280; 165/297; 417/243; 123/563

(58) Field of Search ..... 165/280, 283, 165/284, 297, 103, 231; 123/563; 417/243

(56) References Cited

U.S. PATENT DOCUMENTS

| | | | | |
|---|---|---|---|---|
| 3,712,282 | * | 1/1973 | Isley | 123/563 |
| 5,305,826 | * | 4/1994 | Couetoux | 165/284 |
| 5,423,373 | * | 6/1995 | Ramberg | 165/284 |
| 5,566,881 | * | 10/1996 | Inoue et al. | 165/284 |
| 5,669,363 | * | 9/1997 | Francis | 123/563 |
| 5,752,566 | * | 5/1998 | Liu et al. | 165/110 |
| 5,826,649 | * | 10/1998 | Chapp et al. | 165/110 |
| 5,927,399 | * | 7/1999 | Kazakis et al. | 165/284 |
| 6,003,594 | * | 12/1999 | Cameron et al. | 165/297 |

* cited by examiner

*Primary Examiner*—Ira S. Lazarus
*Assistant Examiner*—Terrell McKinnon
(74) *Attorney, Agent, or Firm*—James Ray & Associates

(57) ABSTRACT

An aftercooler for cooling a compressed fluid exiting from a compressor, the aftercooler including a radiator unit for receiving the compressed fluid exiting from the compressor and for cooling the compressed fluid, the radiator unit having an inlet for receiving the compressed fluid, an outlet for discharging the compressed fluid and a plurality of heat exchange passageways connecting the inlet and the outlet for transferring heat from the compressed fluid. The aftercooler also includes a bypass channel for bypassing the plurality of heat exchange passageways which extends from a first point substantially adjacent the inlet of the radiator unit to a second point substantially adjacent the outlet of the radiator unit. The aftercooler also includes a bypass flow proportioning mechanism that is effective to proportion the flow of the compressed fluid exiting from the compressor and flowing through the aftercooler between the radiator unit and the bypass channel dependent upon a pressure differential across the radiator unit. Preferably, the bypass flow proportioning mechanism is a substantial restriction disposed along the bypass channel which operates to continuously proportion flow between the radiator unit and the bypass channel. The bypass channel is formed substantially integrally with the radiator unit. Preferably, the plurality of heat exchange passageways are arranged to form an array and at least a portion of a length of the bypass channel extends contiguous with a portion of a periphery of the array of the heat exchange passageways.

20 Claims, 1 Drawing Sheet

AFTERCOOLER HAVING BYPASS PASSAGE INTEGRALLY FORMED THEREWITH

CROSS-REFERENCES TO RELATED APPLICATIONS

The present application is directed to similar subject matter as U.S. patent application Ser. No. 08/842,685, filed on Apr. 15, 1997 and entitled "Aftercooler with Integral Bypass Line".

FIELD OF THE INVENTION

The present invention relates, in general, to compressors and, more particularly, the present invention relates to an aftercooler for a compressor used in a pneumatic braking system, the aftercooler being effective to condense water vapor contained within the compressed gas by a cooling effect. The condensed vapor may thereafter be readily removed from the compressed fluid or gas (e.g., air).

Such aftercoolers find particular application in pneumatic braking systems, particularly such pneumatic braking systems as are employed in the rail transportation industry (e.g., trains and light rail vehicles), but other applications are also possible.

BACKGROUND OF THE INVENTION

Pneumatic braking systems are widely employed in rail transport and, additionally, in road based transport, such as heavy trucks. Such pneumatic braking systems utilize air at an elevated pressure which is commonly provided by an onboard compressor that supplies the air compressed thereby to at least one compressed air reservoir. The compressed air reservoir in turn feeds a pneumatic line commonly referred to as a "brake pipe" which is made up of sequential sections located in the railcars that are coupled together when a train if formed or reformed. The brake pipe, therefore, typically runs the length of the train supplying the compressed air to each railcar thereof. In each railcar, the compressed air normally supplies at least an auxiliary reservoir and typically, in addition, an emergency reservoir, which in turn feed compressed air to the brake cylinders of the railcar dependent upon the brake pipe pressure, which is controlled by the engineer. The compressed air supply is additionally often put to ancillary uses, such as air horns, etc.

It is well understood that the relative amount of moisture that air is capable of carrying in vapor form varies directly with respect to the temperature of the air and inversely with respect to the pressure of the air. The onboard compressors employed in pneumatic braking systems raise the temperature of the air during compression and also raise, of course, the pressure of the air. The rise in the temperature of the air due to compression in increasing its vapor carrying capacity typically more than offsets the effect of the pressure rise (which tends to decrease its vapor carrying capacity), with the result that substantially all of the original water content of the air remains suspended in vapor form at the elevated pressure and temperature.

If such compressed air at the resulting elevated temperature is introduced immediately into the reservoir and subsequently into the brake pipe, it will cool toward the ambient temperature and eventually lose its ability to carry such a high water content suspended as vapor. Condensation then forms along the brake pipe and all of the components receiving compressed air therefrom. Such condensation can have substantially harmful effects on the pneumatic components and lubricants employed, for example, by washing away the lubricants or by freezing in cold climates.

DESCRIPTION OF THE RELATED ART

One approach to this problem has been to cool the compressed air to near ambient temperature upon its exit from the onboard compressor and before introducing it into the reservoir and brake pipe. The effect is to condense the excess water content from the compressed air immediately, before its introduction into the various pneumatic components.

A known arrangement for cooling the compressed air prior to introducing it into the pneumatic system utilizes a relatively long length of pipe normally provided with fins to aid in heat dissipation. Typically, this long length of pipe is disposed beneath the floor boards of the locomotive and is configured in a serpentine fashion to permit its accommodation there. However, perhaps due to insufficient circulation of the ambient air to such location, this known arrangement frequently fails to sufficiently cool the compressed air and thereby provide adequate removal of suspended water vapor.

U.S. Pat. No. 5,106,270 issued to Goettel et al. on Apr. 21, 1992 and entitled "Air-Cooled Compressor", which is hereby incorporated by reference with the same effect as if the contents thereof were expressly set forth herein, utilizes another approach to the problem. Goettel et al. describes an integral compressor/aftercooler combination. The compressor has two low pressure compression chambers which compress filtered ambient air to a first elevated pressure. The output from the two low pressure chambers is then cooled by respective integrally provided intercoolers before being fed therefrom to a common high pressure compression chamber for compression to a second higher elevated pressure. The output from the high pressure chamber is directed to an integrally provided aftercooler, which includes a radiator-like structure having a plurality of tube-like passages. A fan is disposed to direct ambient air over the radiator-like structure. The compressed air traveling through the plurality of tube-like passages is cooled to substantially within from about 8° F. to about 18° F. above ambient temperature and a great deal of excess moisture is thereby condensed from the now compressed air.

The cooled air exiting from the aftercooler unit of the Goettel et al. compressor forcibly carries with it the condensed vapor in the form of water droplets. In Goettel et al., this output from the aftercooler is provided directly to the compressed air reservoir, which includes drain cocks to allow the condensed vapor to be drained therefrom. However, alternatively or in combination, it is possible to interpose an air drying unit between the aftercooler and the reservoir. One example of an air drying unit is to be found in U.S. patent application Ser. No. 08/597,076, which is hereby expressly incorporated by reference herein. Such air drying units are usually quite effective at removing moisture. Another known air drying unit is marketed by Westinghouse Air Brake Company under the name Vaporid Air Dryer and utilizes twin chambers of a desiccant material, the two chambers being alternately active with intermittent periods of regeneration. The aftercooler device described above works quite well when it is being operated in environments where the ambient temperature is above freezing. However, if used in freezing or near freezing ambient temperatures, such an aftercooler device may "freeze up". That is, the condensed water which forms within the aftercooler can freeze within the relatively narrow passages thereof, substantially blocking or at least considerably restricting the air flow therethrough.

Solutions to this problem have included a bypass line which connects between the outlet of the compressor and the inlet of the reservoir (or the inlet of an air dryer unit if one is employed) Whether the air exiting the compressor is routed through the aftercooler or through the bypass line is controlled by a pressure sensitive bypass valve. As the aftercooler becomes blocked, a pressure differential (i.e., a pressure drop) across the aftercooler increases. When the pressure differential reaches a threshold value, the air exiting the compressor is switched to flow through the bypass line, bypassing the aftercooler. The aftercooler is thus allowed to thaw during a period in which the uncooled air flows directly into the reservoir or air dryer unit. Once any ice restrictions are sufficiently removed due to thawing, the pressure difference falls below the threshold value and the pressure sensitive bypass valve functions to once again route the air flow through the aftercooler.

The disadvantages of allowing uncooled compressed air to flow directly into the pneumatic system have been pointed out above: e.g., the high temperature compressed air carries excess water vapor that condenses as it cools to ambient temperature in its passage through the various pneumatic components, washing away lubricants and possibly freezing at critical points of the system. The known system, by removing the aftercooler for significant periods of time clearly raises the possibility of such problems.

U.S. patent application Ser. No. 08/842,685, filed on Apr. 15, 1997 and entitled "Aftercooler with Integral Bypass Line", which is cross-referenced above, relates to an aftercooler having a radiator unit that includes a first inlet connected to a compressor, an outlet connected to the next component of a gas drying system and a second inlet to the radiator unit located near a portion of the radiator unit most likely to freeze. A bypass line is connected, at one end, between the compressor and the first inlet and, at another end, to the second inlet. A bypass valve senses a pressure difference between the first inlet and approximately the outlet and routes the air exiting the compressor through the radiator unit via the first inlet when the sensed pressure difference is at or below a threshold value. The bypass valve routes the air exiting the compressor through the bypass valve to the second inlet of the radiator unit when the sensed pressure difference exceeds the threshold value to thaw any frozen condensed moisture that has accumulated there.

OBJECTS OF THE INVENTION

One object of the present invention is the provision of an aftercooler having a radiator unit and being equipped with a bypass line and a bypass flow proportioning mechanism for proportioning flow of compressed fluid between the radiator unit and the bypass channel to thereby rapidly thaw any frozen condensate that may form in the radiator unit of the aftercooler.

Another object of the present invention is the provision of such an aftercooler equipped with a bypass channel and a bypass flow proportioning mechanism, wherein the bypass flow proportioning mechanism is of particularly simple and inexpensive construction (e.g., a restrictive orifice) and operates to proportion flow through the radiator unit and the bypass channel on a continuously variable basis.

Another object of the present invention is the provision of such an aftercooler equipped with a bypass line, wherein the bypass line is integrally formed with the aftercooler thereby reducing the number of required connections between the aftercooler and the bypass line and thus increasing reliability.

A further object of the present invention is the provision of such an aftercooler equipped with a bypass line wherein the bypass line is integrally formed with the aftercooler as a single piece construction to thereby significantly reduce fabrication and assembly costs.

A still further object of the present invention is the provision of such an aftercooler equipped with a bypass line wherein the bypass line is disposed to extend substantially contiguous with a peripheral portion of the aftercooler to produce a product that conserves space through a substantially compact single plane design.

In addition to the objects and advantages of the present invention described above, various other objects and advantages of the invention will become more readily apparent to those persons skilled in the relevant art from the following more detailed description of the invention, particularly when such description is taken in conjunction with the attached drawing Figures and with the appended claims.

SUMMARY OF THE INVENTION

In one aspect, the invention generally features an aftercooler for cooling a compressed fluid exiting from a compressor, the aftercooler including a radiator unit for receiving the compressed fluid exiting from the compressor and for cooling the compressed fluid, the radiator unit having an inlet for receiving the compressed fluid, an outlet for discharging the compressed fluid and a plurality of heat exchange passageways connecting the inlet and the outlet for transferring heat from the compressed fluid. The aftercooler also includes a bypass channel for bypassing the plurality of heat exchange passageways, the bypass channel extending from a first point substantially adjacent the inlet of the radiator unit to a second point substantially adjacent the outlet of the radiator unit. The aftercooler further includes a flow proportioning mechanism. The flow proportioning mechanism is effective to proportion the flow of the compressed fluid exiting from the compressor and flowing through the aftercooler between the radiator unit and the bypass channel dependent upon a pressure differential across the radiator unit.

In another aspect, the invention generally features an aftercooler for cooling a compressed fluid exiting from a compressor, the aftercooler including a radiator unit for receiving the compressed fluid exiting from the compressor and for cooling the compressed fluid, the radiator unit having an inlet for receiving the compressed fluid, an outlet for discharging the compressed fluid and a plurality of heat exchange passageways connecting the inlet and the outlet for transferring heat from the compressed fluid to an ambient environment. The plurality of heat exchange passageways are arranged to form an array of the plurality of heat exchange passageways. The aftercooler additionally includes a bypass channel for bypassing the plurality of heat exchange passageways. The bypass channel extends from a first point substantially adjacent the inlet of the radiator unit to a second point substantially adjacent the outlet of the radiator unit. A pressure activated bypass valve directs flow of the compressed fluid through the plurality of heat exchange passageways and the bypass channel. At least a portion of a length of the bypass channel extends contiguous with a portion of a periphery of the array of the heat exchange passageways.

In preferred embodiments, for example, the flow proportioning mechanism includes a substantial restriction that is disposed along at least a portion of the bypass channel; the aftercooler includes an inlet header and an outlet header; the bypass channel connects the inlet header to the outlet header; the substantial restriction includes a substantially restricted orifice; and the substantially restricted orifice is circular, of ½ inch diameter and connects the inlet header to the bypass channel.

The present invention will now be described by way of a particularly preferred embodiment, reference being made to the various Figures of the accompanying drawings, wherein:

DETAILED DESCRIPTION OF THE PREFERRED EMBODIMENT

Figure 1:
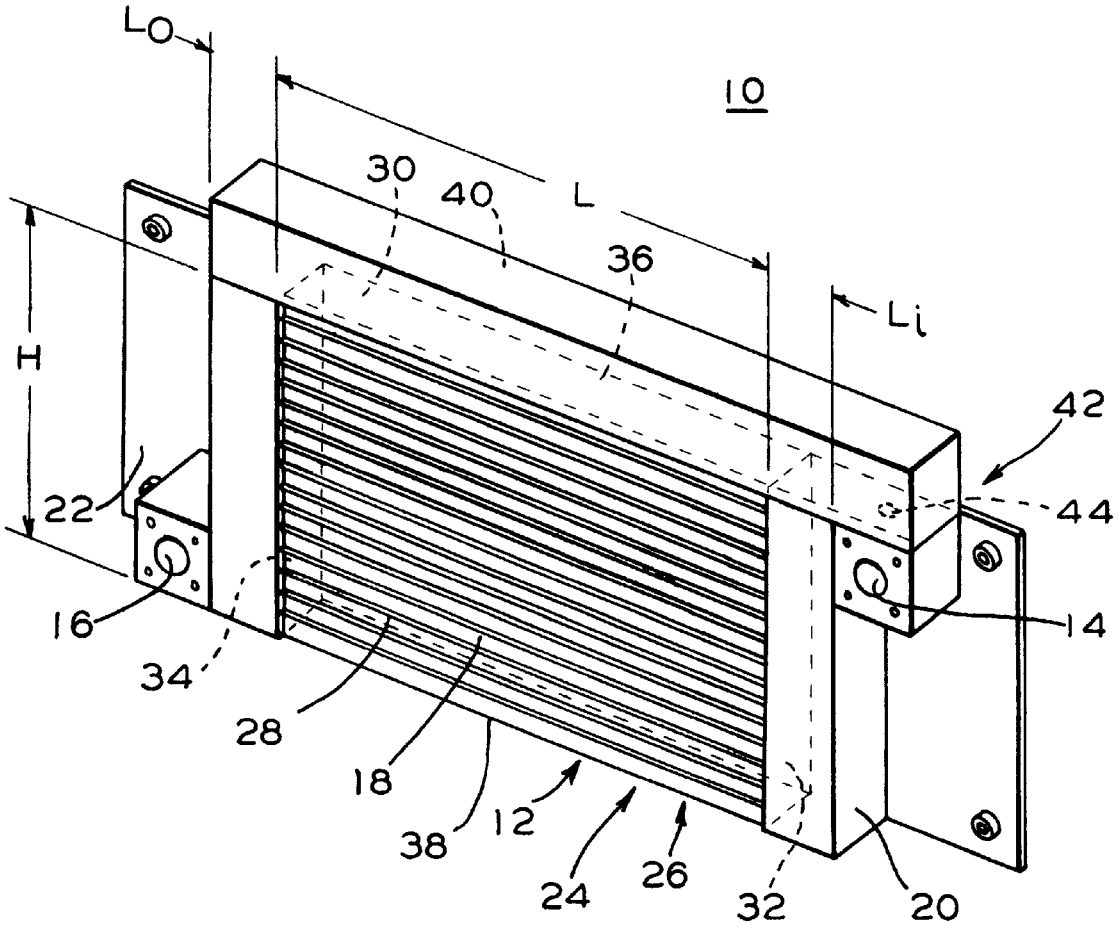
FIG. 1 is a perspective view of a preferred embodiment of an aftercooler constructed according to the present invention.

Prior to proceeding to a much more detailed description of the present invention, it should be noted that identical components which have identical functions have been identified with identical reference numerals throughout the several views illustrated in the drawing Figures for the sake of clarity and understanding of the invention.

Referring now to FIG. 1, an aftercooler constructed according to the present invention and generally designated by reference numeral 10 is adapted for receiving a compressed fluid (most particularly air) exiting from a compressor unit. The aftercooler 10 generally includes a radiator unit 12 which has an inlet 14 for receiving the compressed fluid and an outlet 16 for discharging the compressed fluid to a downstream air drying unit and/or reservoir after it has passed through the radiator unit 12. The radiator unit 12 further includes a number of heat exchange passageways 18 which interconnect the inlet 14 with the outlet 16 and which cool the compressed fluid during its passage therethrough.

The heat exchange passageways 18 are preferably constructed in the form of a plurality of flow tubes that extend between an inlet header 20 and an outlet header 22 located upstream and downstream, respectively, of the radiator unit 12. The inlet header 20 is disposed between the inlet 14 and the heat exchange passageways 18, thereby supplying the heat exchange passageways 18 with compressed fluid entering the radiator unit 12 through the inlet 14. The outlet header 22 is disposed between the heat exchange passageways 18 and the outlet 16 and collects the compressed fluid exiting from the heat exchange passageways 18 for discharge from the radiator unit 12 through the outlet 16.

The heat exchange passageways 18 are preferably constructed of a material having a relatively high degree of thermal conductivity such that a substantial amount of heat will be transferred from the compressed fluid to the ambient environment surrounding the aftercooler 10 during the flow of the compressed fluid through the heat exchange passageways 18. To this end, a forced flow of air may be directed over the heat exchange passageways 18 to increase the heat transferred, e.g., through the use of fan blades or channeling, etc.

Preferably, the heat exchange passageways 18 are disposed in parallel such that they generally define an array 24 of heat exchange passageways 18. Additionally, the array 24 of heat exchange passageways 18 is preferably disposed so as to define the shape of a rectangular parallelepiped 26, that is, a prism having opposing substantially rectangular faces. The rectangular parallelepiped 26 defined by the array 24 of heat exchange passageways 18 has a pair of opposing rectangular major faces 28 and 30. The rectangular major face 28 is directly visible in FIG. 1, while the other rectangular major face 30 is disposed on the reverse side of the radiator unit 12 from the rectangular major face 28 directly visible in FIG. 1. The other rectangular major face 30 is therefore indicated in phantom in FIG. 1. The rectangular parallelepiped 26 defined by the array 24 of heat exchange passages 18 has a height H and a length L shown in FIG. 1.

The rectangular parallelepiped 26 defined by the array 24 of heat exchange passageways 18 is bounded by four substantially planar surfaces (or sides): a first two planar surfaces 32 and 34 which extend over the height H of the rectangular parallelepiped 26 and a second two planar surfaces 36 and 38 which extend over the length L of the rectangular parallelepiped 26. The planar surface 32 substantially defines a side surface and boundary of the array 24 of heat exchange passages 18 adjacent the inlet header 20; the planar surface 34 substantially defines a side surface and boundary of the array 24 of heat exchange passages 18 adjacent the outlet header 22; the planar surface 36 substantially defines an upper surface and boundary of the array 24 of heat exchange passages 18; and the planar surface 38 substantially defines a lower surface and boundary of the array 24 of heat exchange passages 18.

During cooling, as it passes through the heat exchange passageways 18, the ability of the compressed fluid to carry water content in a vapor form will substantially decrease. Thus, considerable condensation may occur. The greater portion of condensate produced will tend to collect near the outlet 16, which is the coolest portion of the flow path through the aftercooler 10. As noted above, in freezing or near freezing environments, this condensate can have a tendency to freeze and substantially block the flow path through the aftercooler 10.

Rather than completely bypassing the aftercooler 10 until the frozen condensate thaws of its own accord and therefore passing an undesirable amount of water vapor to the downstream pneumatic components, the aftercooler 10 is additionally provided with a bypass channel 40. As seen in FIG. 1, the bypass channel 40 is substantially integrally formed with the radiator unit 12 such that the radiator unit 12 and the bypass channel 40 form a single piece design.

The bypass channel 40 is disposed such that it forms at least a portion of the periphery of the array 24 of heat exchange passageways 18 which define the rectangular parallelepiped 26. Preferably, as shown in FIG. 1, the bypass channel 40 extends contiguous with at least a portion of the periphery of the array 24 of heat exchange passageways 18. Even more preferably, the bypass channel 40 extends substantially continuously over and in substantially contiguous and abutting relationship with at least one of the four planar surfaces 32, 34, 36 and 38 of the rectangular parallelepiped 26 which bounds the array 24 of heat exchange passageways 18. Most preferably, as also seen in FIG. 1, the bypass channel 40 extends substantially continuously over and in substantially contiguous and abutting relationship with the upper planar surface 36 of the rectangular parallelepiped 26 which bounds the array 24 of heat exchange passageways 18. That is, the bypass channel 40 extends substantially continuously over and in substantially contiguous and abutting relationship over the length L of the upper planar surface 36 of the rectangular parallelepiped 26 which bounds the array 24 of heat exchange passageways 18. Moreover, as can be seen in FIG. 1, the bypass passage additionally extends on both sides of the upper planar surface 36 for additional distances $L_i$ and $L_o$ over the extent of the intake header 20 and outlet header 22, respectively.

The bypass channel 40 is connected to the inlet header 20 through a bypass flow proportioning mechanism, indicated generally by reference numeral 42 in FIG. 1. The bypass flow proportioning mechanism 42 operates to proportion the flow of the compressed fluid which is received from the upstream compressor into two separate streams of flow. A first flow, which includes the majority of the flow received from the upstream compressor, is directed by the bypass flow proportioning mechanism 42 through the radiator unit 12, that is through the array 24 of heat exchange passageways 18. A second lesser flow is directed by the bypass flow proportioning mechanism 42 through the bypass channel 40. The bypass flow proportioning mechanism 42 functions to regulate and continuously vary the proportion of the compressed fluid flow which is diverted to the bypass channel 40 as a function of the pressured differential (i.e., pressure drop) which exists across the radiator unit 12 (i.e., the array 24 of heat exchange passageways 18).

During operation in ambient temperatures of above freezing, the pressure drop across the radiator unit 12 will be relatively low. In such cases, the bypass flow proportioning mechanism 42 directs nearly all of the compressed fluid flow through the radiator unit 12. However, during operation in ambient temperatures which are near or below freezing, the radiator unit 12 will, as explained above, have a tendency to "freeze up", thereby raising the pressure drop across the radiator unit 12. In such conditions, the bypass flow proportioning mechanism 42 functions to divert, on a continuously variable basis, more of the compressed fluid exiting the upstream compressor through the bypass channel 40 as the pressure drop across the radiator unit 12 increases. The uncooled compressed fluid diverted through the bypass channel 40 by the bypass flow proportioning mechanism 42 reaches a point adjacent the outlet 16 via the outlet header 22 and thaws any ice build up that tends to form in the array 24 of heat exchange passageways 18 adjacent that point. The pressure drop across the radiator unit 12 decreases with such thawing, and the bypass flow proportioning mechanism 42 therefore diverts less compressed fluid flow through the bypass channel 40.

In the presently preferred embodiment, the bypass flow proportioning mechanism 42 includes a substantial restriction which is positioned at some point along the bypass channel 40. Most preferably, the substantial restriction is presently in the form of a restrictive orifice 44. Even more preferably, the restrictive orifice 44 is provided between the bypass channel 40 and the inlet header 20. However, it will be appreciated by those of ordinary skill in the art that the restrictive orifice 44 may be positioned at substantially any point along the flow of the bypass channel 40.

When the aftercooler 10 is used in combination with a well known air compressor unit frequently used for pneumatic braking systems for the rail transportation industry, namely a "3-CD" type Air Compressor (and most particularly a "3CDCLA" Air Compressor) produced by Westinghouse Air Brake Company, the present inventors have achieved good results utilizing a restrictive orifice 44 which has a diameter of substantially about ½ inch.

As shown in FIG. 1, the bypass channel 40 preferably has, at present, a cross-sectional profile that is substantially rectangular, although average artisans will appreciate that other cross-sectional profiles may be substituted therefor. For example, a substantially round cross-sectional or "U-shaped" profile may be employed for the bypass channel 40.

Additionally, the present inventors have had good results using the present inventive aftercooler in combination with the above described "3-CD" air compressor when the bypass channel 40 is dimensioned to have a cross-sectional area of at least about 3.356 square inches, which is the interior cross-sectional area of a standard 2 inch pipe.

The present inventors have conducted tests of the inventive aftercooler 10, wherein the aftercooler 10 and an interconnected "3CDCLA" are run within a temperature variable environmental chamber, in order to simulate operation under sub-freezing conditions. The temperature of the air exiting the aftercooler 10 (e.g., from the outlet 16) is monitored. As the ambient temperature within the environmental chamber is lowered to the freezing point of 32 degrees Fahrenheit, the temperature of the air exiting the aftercooler 10 dips to near or below freezing but then rises as the restrictive orifice 44 diverts a greater proportion of the compressed fluid through the bypass channel 40, thereby thawing any frozen condensate in the radiator unit 12.

The particularly preferred diameter of the restrictive orifice 44 of ½ inch appears at present to provide good operational characteristics. For example, utilizing a ½ inch restrictive orifice 44 during the above described operational tests, the 3CDCLA compressor may be run at full speed without tripping any over pressure safety valves. Moreover, it is believed that during operation in above-freezing environments, a relatively small proportion of the compressed fluid received from the upstream compressor is diverted through the bypass channel 40, but rather follows the path of least resistance through the radiator unit 12. In other words, it is believed that the restrictive orifice 44 presents a substantial resistance to appreciable flow through the. bypass channel 40 until such point as frozen condensate begins to block the array 24 of heat exchange passageways 18 thereof.

While the present invention has been described by way of a detailed description of a particularly preferred embodiment or embodiments, it will be apparent to those of ordinary skill in the art that various substitutions of equivalents may be affected without departing from the spirit or scope of the invention as set forth in the appended claims.

What we claim is:

1. An aftercooler for cooling a compressed fluid exiting from a compressor, said aftercooler comprising:

a radiator unit for receiving such compressed fluid exiting from such compressor and for cooling such compressed fluid, said radiator unit including an inlet for receiving such compressed fluid, an outlet for discharging such compressed fluid and a plurality of heat exchange passageways connecting said inlet and said outlet for transferring heat from such compressed fluid;

said plurality of heat exchange passageways being arranged to form an array of said plurality of heat exchange passageways;

said array of said plurality of heat exchange passageways being disposed substantially in the shape of a parallelepiped having two opposing major faces; and said parallelepiped being bounded by four sides joining said two opposing major faces of said parallelepiped;

a bypass channel for bypassing said plurality of heat exchange passageways, said bypass channel extending from a first point substantially adjacent said inlet of said radiator unit to a second point substantially adjacent said outlet of said radiator unit;

said bypass channel carrying a bypass flow comprising a portion of such compressed fluid exiting from such compressor, said bypass flow substantially completely bypassing, and substantially not passing through, said plurality of heat exchange passageways; and said bypass channel extending substantially continuously over and being in substantially contiguous and abutting relationship with two of said four sides bounding said parallelepiped, said two of said four sides over which said bypass channel extends and abuts with being two adjoining and adjacent sides of said parallelepiped; and a flow proportioning mechanism, said flow proportioning mechanism being effective to proportion such flow of such compressed fluid exiting from such compressor and flowing through said aftercooler between said radiator unit and said bypass channel dependent upon a pressure differential across said radiator unit.

2. An aftercooler for cooling a compressed fluid exiting from a compressor, according to claim 1, wherein:

said flow proportioning mechanism comprises a substantial restriction, said substantial restriction being disposed along at least a portion of said bypass channel;

said bypass channel is formed substantially integrally with said radiator unit;

said radiator unit additionally comprises an inlet header connecting said inlet to each of said plurality of heat exchange passageways and an outlet header connecting said outlet to each of said plurality of heat exchange passageways; and said bypass channel connects said inlet header to said outlet header.

3. An aftercooler for cooling a compressed fluid exiting from a compressor, according to claim 1, wherein:

said four sides bounding said parallelepiped comprise four substantially planar surfaces adjoining said two opposing major faces of said parallelepiped; and said bypass channel extends substantially continuously over and in substantially contiguous and abutting relationship with two adjoining and adjacent substantially planar surfaces of said four substantially planar surfaces bounding said parallelepiped.

4. An aftercooler for cooling a compressed fluid exiting from a compressor, according to claim 3, wherein:

one of said four substantially planar surfaces bounding said parallelepiped is an upper surface of said array of said plurality of heat exchange passageways; and said bypass channel extends substantially continuously over and in substantially contiguous and abutting relationship with said upper surface of said array of said plurality of heat exchange passageways.

5. An aftercooler for cooling a compressed fluid exiting from a compressor, according to claim 4, wherein:

said parallelepiped is a rectangular parallelepiped;

said two opposing major faces of said rectangular parallelepiped are substantially rectangular;

said radiator unit additionally comprises an inlet header connecting said inlet to each of said plurality of heat exchange passageways and an outlet header connecting said outlet to each of said plurality of heat exchange passageways;

said bypass channel connects said inlet header to said outlet header; and said bypass channel additionally extends over both of said inlet header and said outlet header.

6. An aftercooler for cooling a compressed fluid exiting from a compressor, according to claim 2, wherein said substantial restriction comprises a substantially restricted orifice.

7. An aftercooler for cooling a compressed fluid exiting from a compressor, according to claim 6, wherein:

said substantially restricted. orifice is of substantially circular cross section;

said substantially restricted orifice connects said bypass channel to said inlet header; and said substantially restricted orifice is formed in said inlet header and is separate and distinct from said inlet.

8. An aftercooler for cooling a compressed fluid exiting from a compressor, according to claim 7, wherein said substantially restricted orifice connecting said bypass channel to said inlet header has a diameter of substantially about ½ inch.

9. An aftercooler for cooling a compressed fluid exiting from a compressor, according to claim 1, wherein said bypass channel has a cross-sectional area of at least about 3.356 square inches.

10. An aftercooler for cooling a compressed fluid exiting from a compressor, according to claim 1, wherein said bypass channel has a substantially rectangular shaped cross-section and wherein said plurality of heat exchange passageways are adapted for transferring heat from such compressed fluid to an ambient environment.

11. An aftercooler for cooling a compressed fluid exiting from a compressor, said aftercooler comprising:

a radiator unit for receiving such compressed fluid exiting from such compressor and for cooling such compressed fluid, said radiator unit including an inlet for receiving such compressed fluid, an outlet for discharging such compressed fluid and a plurality of heat exchange passageways connecting said inlet and said outlet for transferring heat from such compressed fluid to an ambient environment;

said plurality of heat exchange passageways being arranged to form an array of said plurality of heat exchange passageways;

a bypass channel for bypassing said plurality of heat exchange passageways, said bypass channel extending from a first point substantially adjacent said inlet of said radiator unit to a second point substantially adjacent said outlet of said radiator unit;

said bypass channel carrying a bypass flow comprising a portion of such compressed fluid exiting from such compressor, said bypass flow substantially completely bypassing, and substantially not passing through, said plurality of heat exchange passageways;

at least a portion of a length of said bypass channel extending contiguous with a portion of a periphery of said array of said heat exchange passageways; and a bypass flow proportioning mechanism, said bypass flow proportioning mechanism being effective to divert a portion of such flow of such compressed fluid exiting from such compressor through said bypass channel to thereby bypass said radiator unit, said portion of such flow of such compressed fluid exiting from such compressor and diverted through said bypass channel being continuously variable dependent upon a pressure differential across said radiator unit;

said bypass flow proportioning mechanism comprising a substantially restricted orifice disposed along said bypass channel.

12. An aftercooler for cooling a compressed fluid exiting from a compressor, according to claim 11, wherein:

said radiator unit additionally comprises an inlet header connecting said inlet to each of said plurality of heat exchange passageways and an outlet header connecting said outlet to each of said plurality of heat exchange passageways; and said bypass channel connects said inlet header to said outlet header.

13. An aftercooler for cooling a compressed fluid exiting from a compressor, according to claim 11, wherein:

said array of said plurality of heat exchange passageways is substantially in the shape of a rectangular parallelepiped;

said rectangular parallelepiped has two opposing substantially rectangular major faces;

said rectangular parallelepiped is bounded by four sides joining said two opposing substantially rectangular major faces of said parallelepiped; and said bypass channel extends substantially continuously over and in substantially contiguous and abutting relationship with two of said four sides bounding said parallelepiped, said two of said four sides over which said bypass channel extends and abuts with being two adjoining and adjacent sides of said parallelepiped.

14. An aftercooler for cooling a compressed fluid exiting from a compressor, according to claim 11, wherein said bypass channel has a substantially rectangular shaped cross-section.

15. An aftercooler for cooling a compressed fluid exiting from a compressor, according to claim 13, wherein:

said bypass channel connects to said inlet header at said first point through said substantially restricted orifice, said substantially restricted orifice being or aimed in said inlet header; and said substantially restricted orifice formed in said inlet header is separate and distinct from said inlet.

16. An aftercooler for cooling a compressed fluid exiting from a compressor, according to claim 15, wherein said substantially restricted orifice formed in said inlet header is of substantially circular cross section.

17. An aftercooler for cooling a compressed fluid exiting from a compressor, according to claim 16, wherein:

said array of said plurality of heat exchange passageways has an upper surface extending along a length of said two opposing substantially rectangular faces of said rectangular parallelepiped;

said array of said plurality of heat exchange passageways has two opposing side surfaces extending along a height of said two opposing substantially rectangular faces of said rectangular parallelepiped;

said bypass channel extends substantially continuously over and in substantial contiguous and abutting relationship with said upper surface of said array of said plurality of heat exchange passageways;

said inlet header extends substantially continuously over and in substantial contiguous and abutting relationship with one of said two opposing side surfaces of said array of said plurality of heat exchange passageways; and said outlet header extends substantially continuously over and in substantial contiguous and abutting relationship with another of said two opposing side surfaces of said array of said plurality of heat exchange passageways.

18. An aftercooler for cooling a compressed fluid exiting from a compressor, according to claim 15, wherein said substantially restricted orifice formed in said inlet header has a diameter of substantially about ½ inch.

19. An aftercooler for cooling a compressed fluid exiting from a compressor, according to claim 11, wherein said bypass channel has a substantially rectangular cross-sectional profile.

20. An aftercooler for cooling a compressed fluid exiting from a compressor, according to claim 11, wherein said bypass channel has a cross-sectional area of at least about 3.356 square inches.

* * * * *